US006286259B1

(12) United States Patent
Zeng et al.

(10) Patent No.: US 6,286,259 B1
(45) Date of Patent: Sep. 11, 2001

(54) WINDOW SHOE DEVICE

(76) Inventors: Qixiang Zeng; Suiping Wei, both of 9740 62nd Dr., #11 H, Rego Park, NY (US) 11374

( * ) Notice: Subject to any disclaimer, the term of this patent is extended or adjusted under 35 U.S.C. 154(b) by 0 days.

(21) Appl. No.: 09/437,077

(22) Filed: Nov. 9, 1999

(51) Int. Cl.[7] ..... E05D 15/22
(52) U.S. Cl. ..... 49/181; 49/182; 49/447
(58) Field of Search ..... 49/176, 181, 182, 49/447, 453, 446; 16/193, 196

(56) References Cited

U.S. PATENT DOCUMENTS

| | | | | |
|---|---|---|---|---|
| D. 317,713 | | 6/1991 | Kaplan . | |
| 3,611,636 | | 10/1971 | Trout . | |
| 3,959,926 | | 6/1976 | Noecker et al. . | |
| 4,683,676 | | 8/1987 | Sterner, Jr. . | |
| 4,941,285 | | 7/1990 | Westfall . | |
| 5,243,783 | | 9/1993 | Schmidt et al. . | |
| 5,704,165 | * | 1/1998 | Slocomb et al. | 49/181 |
| 5,924,243 | * | 7/1999 | Polowinczac et al. | 49/181 |
| 5,943,822 | * | 8/1999 | Slocomb et al. | 49/181 |
| 6,041,475 | * | 3/2000 | Nidelkoff | 16/193 |
| 6,058,653 | * | 5/2000 | Slocomb et al. | 49/181 |
| 6,119,398 | * | 9/2000 | Yates, Jr. | 49/181 |
| 6,161,335 | * | 12/2000 | Beard et al. | 49/181 |

* cited by examiner

*Primary Examiner*—Jerry Redman
*Assistant Examiner*—Curtis A. Cohen

(57) ABSTRACT

A window shoe device for conveniently preventing the drag link from slipping out of the drag link retaining member. The window shoe device includes a housing having a slotted drag link guide portion, a window mount support portion having a hole therethrough, and further includes a window mount member having a slot therein for securely retaining a pivot bar for a window sash and being pivotally supported by the window mount support member, and also includes a window mount retainer member having winged ends for securing the window mount member to the housing, and further includes a drag link retainer member having a pair of prongs extending outwardly for securely retaining a drag link, and also includes a slotted drag link guide reinforcement member removably disposed adjacent to the drag link guide portion.

12 Claims, 3 Drawing Sheets

WINDOW SHOE DEVICE

BACKGROUND OF THE INVENTION

1. Field of the Invention

The present invention relates to a modified slide for retaining a drag link for a window and more particularly pertains to a new window shoe device for conveniently preventing the drag link from slipping out of the drag link retaining member.

2. Description of the Prior Art

The use of a modified slide for retaining a drag link for a window is known in the prior art. More specifically, a modified slide for retaining a drag link for a window heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,243,783; 4,941,285; 4,683,676; 3,959,926; 3,611,636; and Des. 317,713.

While these devices fulfill their respective, particular objectives and requirements, the aforementioned patents do not disclose a new window shoe device. The inventive device includes a housing having a slotted drag link guide portion, a window mount support portion having a hole therethrough, and further includes a window mount member having a slot therein for securely retaining a pivot bar for a window sash and being pivotally supported by the window mount support member, and also includes a window mount retainer member having winged ends for securing the window mount member to the housing, and further includes a drag link retainer member having a pair of prongs extending outwardly for securely retaining a drag link, and also includes a slotted drag link guide reinforcement member removably disposed adjacent to the drag link guide portion.

In these respects, the window shoe device according to the present invention substantially departs from the conventional concepts and designs of the prior art, and in so doing provides an apparatus primarily developed for the purpose of conveniently preventing the drag link from slipping out of the drag link retaining member.

SUMMARY OF THE INVENTION

In view of the foregoing disadvantages inherent in the known types of a modified slide for retaining a drag link for a window now present in the prior art, the present invention provides a new window shoe device construction wherein the same can be utilized for conveniently preventing the drag link from slipping out of the drag link retaining member.

The general purpose of the present invention which will be described subsequently in greater detail, is to provide a new window shoe device which has many of the advantages of the a modified slide for retaining a drag link for a window mentioned heretofore and many novel features that result in a new window shoe device which is not anticipated, rendered obvious, suggested, or even implied by any of the prior art a modified slide for retaining a drag link for a window, either alone or in any combination thereof.

To attain this, the present invention generally comprises a housing having a slotted drag link guide portion, a window mount support portion having a hole therethrough, and further includes a window mount member having a slot therein for securely retaining a pivot bar for a window sash and being pivotally supported by the window mount support member, and also includes a window mount retainer member having winged ends for securing the window mount member to the housing, and further includes a drag link retainer member having a pair of prongs extending outwardly for securely retaining a drag link, and also includes a slotted drag link guide reinforcement member removably disposed adjacent to the drag link guide portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new window shoe device which has many of the advantages of the a modified slide for retaining a drag link for a window mentioned heretofore and many novel features that result in a new window shoe device which is not anticipated, rendered obvious, suggested, or even implied by any of the prior art a modified slide for retaining a drag link for a window, either alone or in any combination thereof.

It is another object of the present invention to provide a new window shoe device which may be easily and efficiently manufactured and marketed.

It is a further object of the present invention to provide a new window shoe device which is of a durable and reliable construction.

An even further object of the present invention is to provide a new window shoe device which is susceptible of a low cost of manufacture with regard to both materials and labor, and which accordingly is then susceptible of low prices of sale to the consuming public, thereby making such window shoe device economically available to the buying public.

Still yet another object of the present invention is to provide a new window shoe device which provides in the apparatuses and methods of the prior art some of the advantages thereof, while simultaneously overcoming some of the disadvantages normally associated therewith.

Still another object of the present invention is to provide a new window shoe device for conveniently preventing the drag link from slipping out of the drag link retaining member.

Yet another object of the present invention is to provide a new window shoe device which includes a housing having a slotted drag link guide portion, a window mount support portion having a hole therethrough, and further includes a window mount member having a slot therein for securely retaining a pivot bar for a window sash and being pivotally supported by the window mount support member, and also includes a window mount retainer member having winged ends for securing the window mount member to the housing, and further includes a drag link retainer member having a pair of prongs extending outwardly for securely retaining a drag link, and also includes a slotted drag link guide reinforcement member removably disposed adjacent to the drag link guide portion.

Still yet another object of the present invention is to provide a new window shoe device that substantially prevents drag slink slippage.

Even still another object of the present invention is to provide a new window shoe device that is convenient, easy to install, simple, and definitely reliable..

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
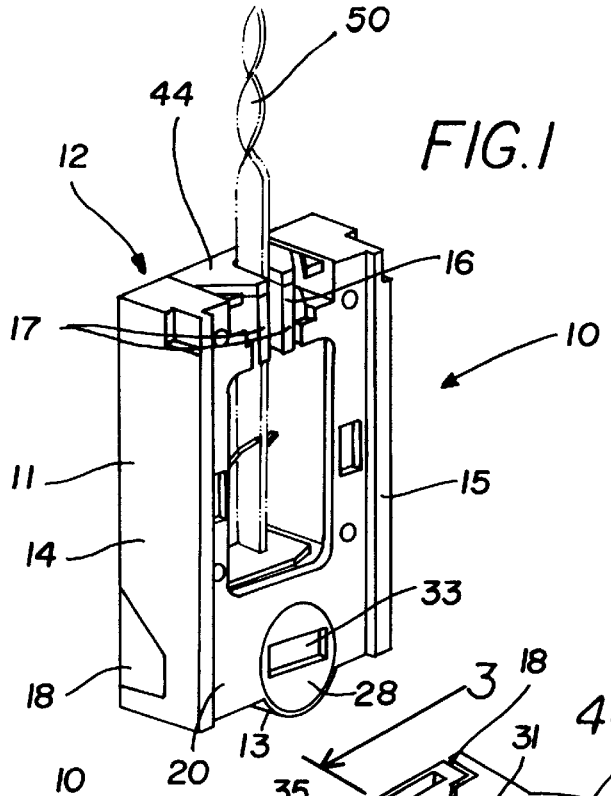
FIG. 1 is a perspective view of a new window shoe device according to the present invention.
Figure 2:
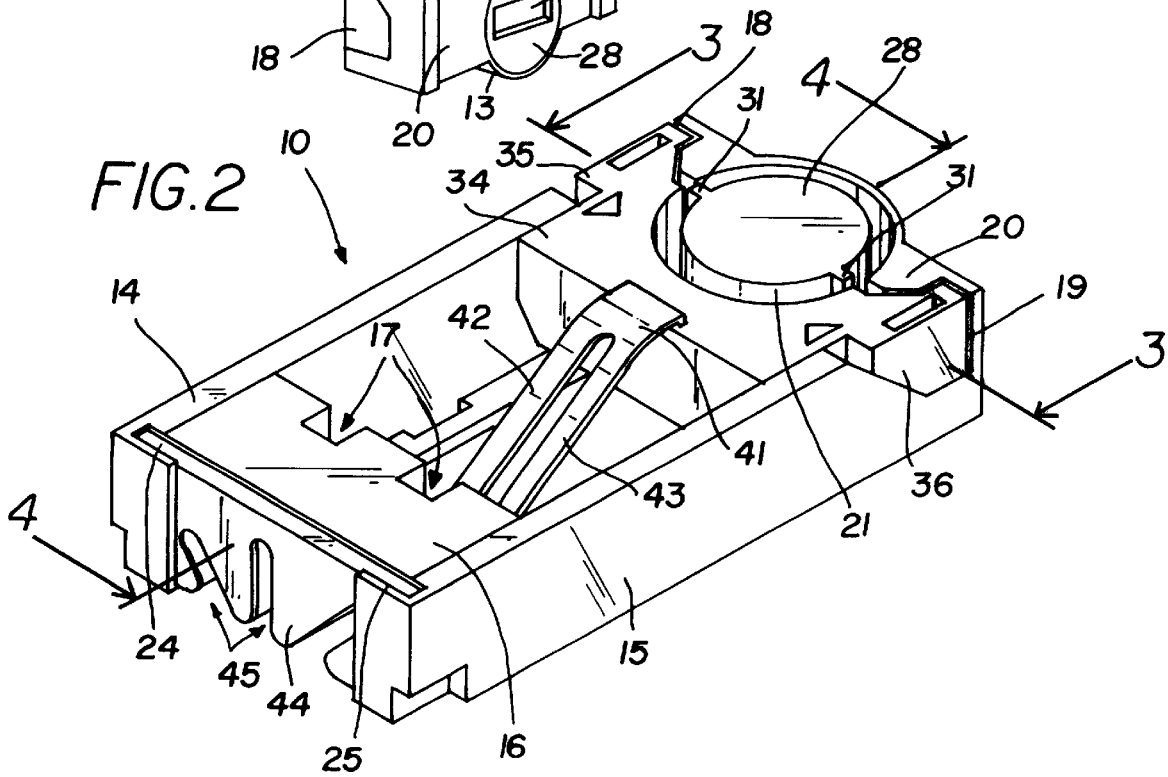
FIG. 2 is another perspective view of the present invention.
Figure 3:
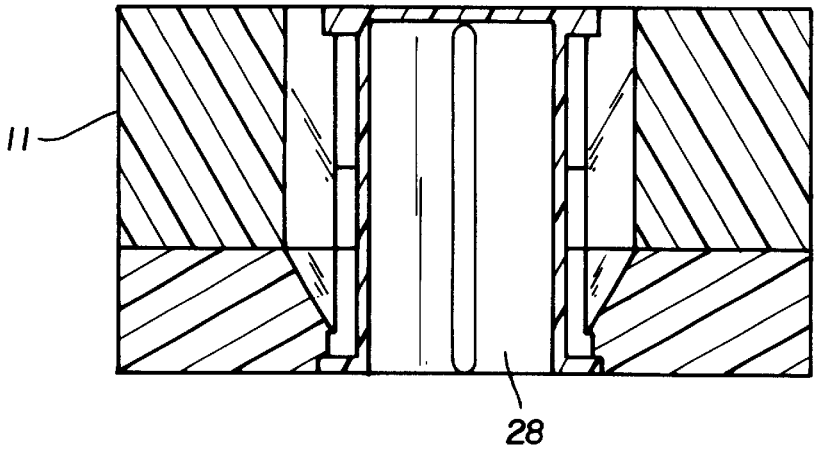
FIG. 3 is a bottom end cross-sectional view of the present invention.
Figure 4:
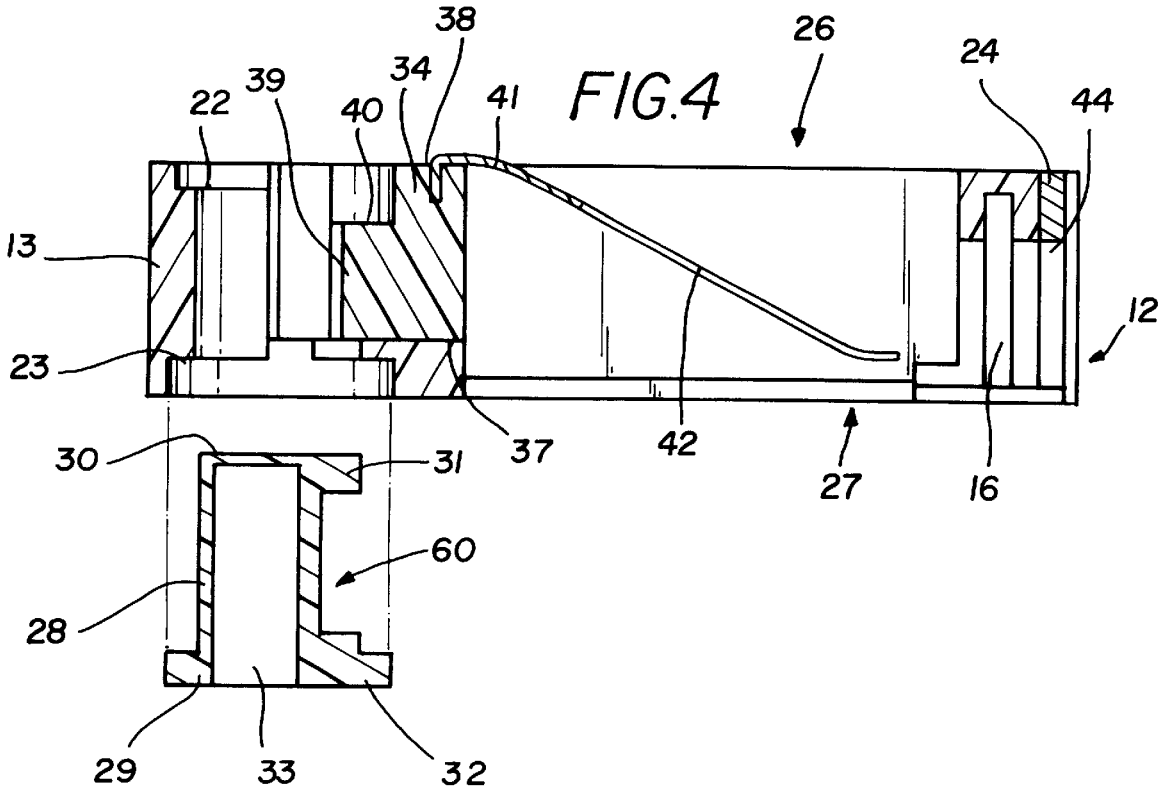
FIG. 4 is a side elevational cross-sectional view of the present invention.
Figure 5:
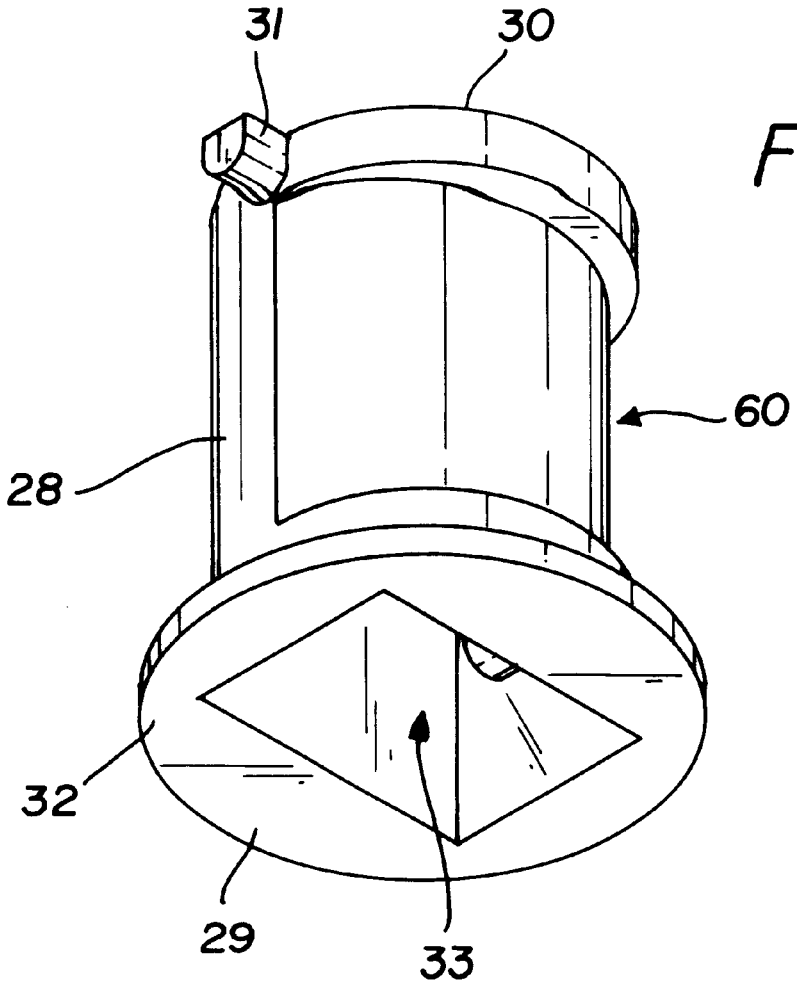
FIG. 5 is a detailed perspective view of the window mount of the present invention.
Figure 6:
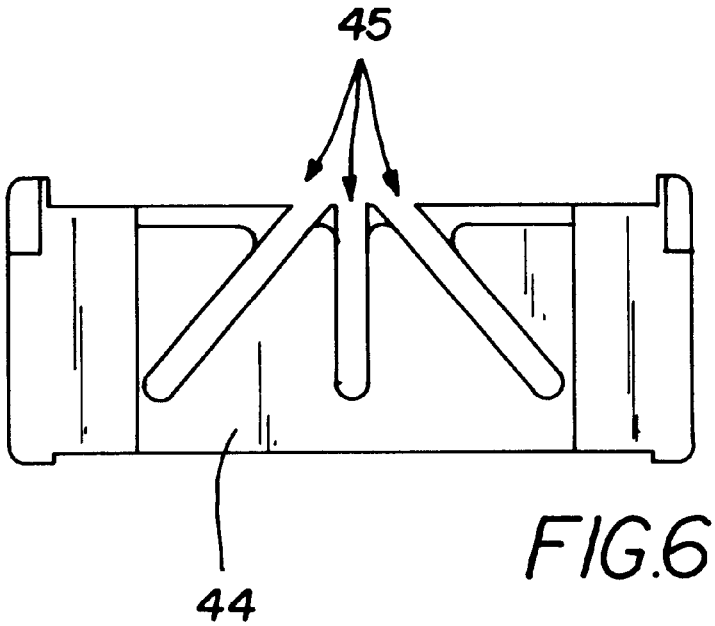
FIG. 6 is a side elevational view of the drag link guide reinforcement member of the present invention.

With reference now to the drawings, and in particular to FIGS. 1 through 6 thereof, a new window shoe device embodying the principles and concepts of the present invention and generally designated by the reference numeral 10 will be described.

As best illustrated in FIGS. 1 through 6, the window shoe device 10 generally comprises a rectangular housing 11 having a front side 27, a back side 26, a top end 12, and a bottom wall 13, and further having a drag link guide portion 16 and a window mount support portion 20 having a hole 21 therethrough. The housing 11 further includes a first side wall 14, a second side wall 15 with a slot 18 extending from the back side 26 into the first side wall 14 and with a slot 19 extending from the back side 26 into the second side wall 15. The housing 11 also includes an arcuate recessed ledge 22 disposed upon an interior of the bottom wall 13. The window mount support portion 20 includes a circular recessed portion 23 extending inwardly from the front side 27 and being disposed about the hole 21. The drag link guide portion 16 is integrally disposed at the top end 12 of the housing 11 and interconnects the first and second side walls 14,15. The drag link guide portion 16 has a plurality of slots 17 extending therein from the front side 27 with the slots 17 being adapted to receive and guide a drag link 50 into the housing 11.

A pivotal window mount is pivotally supported by the window mount support portion 20 and includes a cylindrical member having a first end 29 and a slot 33 extending through the first end 29 into the cylindrical member 28. The cylindrical member 28 of the pivotal window mount includes a flange 32 integrally disposed about the first end 29, and further includes a second end 30, two lugs 31 integrally extending from the second end 30, a side wall, and a semi-circumferentially-extending groove 60 in the side wall.

A means for retaining a drag link and the window mount to the housing 11 and includes a window mount retainer member 34 having a back side 38, a bottom side 39, and winged ends 35,36 which are adapted to be received in respective the slots 18,19 in the first and second side walls 14,15, and further includes an arcuate recess 40 in the back side 38 and on the bottom side 39 thereof for being received in the groove 60 of the cylindrical member 28, and also includes a drag link retainer member 41 having a pair of prongs 42,43 which are spaced from one another and which have an end securely and conventionally attached to a back side 38 of the window mount retainer member 34 and which extend upwardly from and angled forwardly of the window mount retainer member 34.

A drag link guide reinforcement member 44 is securely and conventionally mounted adjacent to the drag link guide portion 16. The housing 11 includes a pair of support slots 24,25 in the top end 12 thereof with the pair of support slots 24,25 being adjacent to the drag link guide portion 16. The drag link guide reinforcement member 44 is essentially a rigid plate member having a longitudinal edge and a plurality of slots 45 extending in the longitudinal edge. The slots 45 of the rigid plate 44 essentially matches the slots 17 in the drag link guide portion 16 when the rigid plate 44 is disposed in the support slots 45.

In use, an end of the pivot bar of the window sash is securely disposed in the slot 33 in the cylindrical member 28 and the end of the drag link 50 is extended through a slot 45 in the drag link reinforcement member 44 and a matching slot 17 in the drag link guide portion 16 with the end of the drag link 50 being securely retained between the prongs 42.43 of the drag link retainer member 41 to essentially prevent the drag link 50 from becoming loose during the sliding and pivoting of the window sash.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A window shoe device comprising:

a rectangular housing having a front side, a back side, a top end, and a bottom wall, said housing including a first side wall and a second side wall, and a drag link guide portion and a window mount support portion having a hole therethrough, said drag link guide portion having at least one slot formed therein for receiving a portion of a drag link;

a pivotal window mount being pivotally supported by said window mount support portion and including a cylindrical member having a first end and a slot extending through said first end into said cylindrical member;

a means for retaining a drag link and said window mount to said housing; and a drag link guide reinforcement member securely mounted adjacent to said drag link guide portion at the top end of said housing, said housing having a pair of opposed support slots formed therein at said top end which respectively receive opposite ends of said drag link guide reinforcement member, said drag link guide reinforcement member having at least one slot formed therein for receiving a portion of the drag link, said at least one slot in said drag link guide reinforcement member being in substantial registration with said at least one slot in said drag link guide portion.

2. A window shoe device as described in claim 1, wherein a slot extends from said back side into said first side wall, and a slot extends from said back side into said second side wall.

3. A window shoe device as described in claim 2, wherein said means for retaining said drag link and said window mount includes a window mount retainer member having a back side, a bottom side, and winged ends which are adapted to be received in respective said slots in said first and second side walls, and further includes an arcuate recess in said back side and on said bottom side thereof for being received in said groove of said cylindrical member.

4. A window shoe device as described in claim 3, wherein said means for retaining said drag link and said window mount further includes a drag link retainer member having a pair of prongs which are spaced from one another and which have an end securely attached to a back side of said window mount retainer member and which extend upwardly from and angled forwardly of said window mount retainer member.

5. A window shoe device as described in claim 1, wherein said housing also includes an arcuate recessed ledge disposed upon an interior of said bottom wall.

6. A window shoe device as described in claim 1, wherein said window mount support portion includes a circular recessed portion extending inwardly from said front side and being disposed about said hole.

7. A window shoe device as described in claim 1, wherein said cylindrical member of said pivotal window mount includes a flange integrally disposed about said first end, and further includes a second end, at least one lug integrally extending from said second end, a side wall, and a semi-circumferentially-extending groove in said side wall.

8. A window shoe device as described in claim 1, wherein said drag link guide portion has at least two slots and said drag link guide reinforcement portion has at least two slots in substantial registration with said at least two slots in said drag link guide portion to form at least two compound slots, and wherein each of said at least two compound slots has a longitudinal axis, and each of said axes intersect at a common point such that said at least two compound slots radiate from said common point.

9. A window shoe device as described in claim 8, wherein said drag link guide portion and said drag link guide reinforcement portion have three compound slots radiating from said common point.

10. A window shoe device comprising:

a rectangular housing having a front side, a back side, a top end, and a bottom wall, and further having a drag link guide portion and a window mount support portion having a hole therethrough, said housing further including a first side wall and a second side wall extending between said drag link guide portion and said window mount support portion, said first and second side walls extending between said drag link guide portion and said window mount support portion to define an opening therebetween for receiving an end of the drag link, a slot extending from said back side into said first side wall, and a slot extending from said back side into said second side wall, said housing also including an arcuate recessed ledge disposed upon an interior of said bottom wall, said window mount support portion including a circular recessed portion extending inwardly from said front side and being disposed about said hole;

a pivotal window mount being pivotally supported by said window mount support portion and including a cylindrical member having a first end and a slot extending through said first end into said cylindrical member, said cylindrical member of said pivotal window mount including a flange integrally disposed about said first end, and further including a second end, at least one lug integrally extending from said second end, a side wall, and a semi-circumferentially-extending groove in said side wall;

a means for retaining a drag link and said window mount to said housing and including a window mount retainer member having a back side, a bottom side, and winged ends which are adapted to be received in respective said slots in said first and second side walls, and further including an arcuate recess in said back side and on said bottom side thereof for being received in said groove of said cylindrical member, said means for retaining said drag link and said window mount further including a drag link retainer member mounted on said window mount retainer member and extending into said opening, said drag link retainer member having a pair of prongs with a slit therebetween for receiving a portion of the drag link for securing the drag link to said housing, said drag link retainer member having an end mounted on a back side of said window mount retainer member, and the prongs of said drag link retainer member extend upwardly from and are angled forwardly of said window mount retainer member; and a drag link guide reinforcement member securely mounted adjacent to said drag link guide portion, said housing including a pair of opposed support slots in said top end thereof which respectively receive opposite ends of said drag link guide reinforcement member, said pair of support slots being adjacent to said drag link guide portion, said drag link guide reinforcement member being essentially a rigid plate member having a longitudinal edge;

wherein said drag link guide portion has at least two slots formed therein and said drag link reinforcement portion has at least two slots formed therein in substantial registration with said at least two slots in said drag link guide portion to form at least two compound slots, and wherein each of said at least two compound slots has a longitudinal axis, and each of said axes intersect at a common point such that said at least two compound slots radiate from said common point.

11. A window shoe device comprising:

a rectangular housing having a front side, a back side, a top end, and a bottom wall, said housing including a first side wall and a second side wall, and a drag link guide portion and a window mount support portion having a hole therethrough, said first and second side walls extending between said drag link guide portion and said window mount support portion to define an opening therebetween for receiving an end of the drag link;

a pivotal window mount being pivotally supported by said window mount support portion and including a cylindrical member having a first end and a slot extending through said first end into said cylindrical member;

a means for retaining a drag link and said window mount to said housing, said means for retaining said drag link and said window mount includes a window mount retainer member having winged ends, said winged ends being removably received in slots formed in said first and second side walls such that said window mount retainer member extends between said side walls, said means for retaining said drag link and said window mount further including a drag link retainer member mounted on said window mount retainer member and extending into said opening, said drag link retainer member having a pair of prongs with a slit therebetween for receiving a portion of the drag link for securing the drag link to said housing.

12. A window shoe device as described in claim 11, wherein the drag link retainer member has an end mounted on a back side of said window mount retainer member, and the prongs of said drag link retainer member extend upwardly from and are angled forwardly of said window mount retainer member.

* * * * *